US009666383B2

(12) United States Patent
Legendre et al.

(10) Patent No.: US 9,666,383 B2
(45) Date of Patent: May 30, 2017

(54) ELECTRICAL CONTACT DEVICE AND LOW-VOLTAGE SINGLE-POLE PHASE UNIT INCORPORATING SUCH AN ELECTRICAL CONTACT DEVICE

(71) Applicant: SCHNEIDER ELECTRIC INDUSTRIES SAS, Rueil-Malmaison (FR)

(72) Inventors: Philippe Legendre, Grenoble (FR); Jean-Paul Gonnet, Fontaine (FR); Denis Giraud, Grenoble (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 156 days.

(21) Appl. No.: 14/592,218

(22) Filed: Jan. 8, 2015

(65) Prior Publication Data

US 2015/0200060 A1 Jul. 16, 2015

(30) Foreign Application Priority Data

Jan. 13, 2014 (FR) ..... 14 50225

(51) Int. Cl.
*H01H 1/06* (2006.01)
*H01H 1/20* (2006.01)
(Continued)

(52) U.S. Cl.
CPC ..... *H01H 1/06* (2013.01); *H01H 1/2041* (2013.01); *H01H 1/66* (2013.01); *H01H 33/56* (2013.01);
(Continued)

(58) Field of Classification Search
CPC ..... H01H 1/2058; H01H 1/226; H01H 1/00; H01H 1/02; H01H 1/385
(Continued)

(56) References Cited

U.S. PATENT DOCUMENTS 5,357,066 A 10/1994 Morel et al.
5,716,222 A * 2/1998 Murphy ..... H01R 13/2435 174/260
6,232,570 B1 5/2001 Castonguay et al.

FOREIGN PATENT DOCUMENTS

EP 0 540 431 A1 5/1993
EP 1 085 552 A1 3/2001
FR 2 861 891 A1 5/2005

OTHER PUBLICATIONS

French Preliminary Search Report issued Aug. 19, 2014, in French Application No. 14 50225 filed Jan. 13, 2014 (with English Translation of Categories of Cited Documents).

* cited by examiner

*Primary Examiner* — Renee S Luebke
*Assistant Examiner* — Ahmed Saeed
(74) *Attorney, Agent, or Firm* — Oblon, McClelland, Maier & Neustadt, L.L.P.

(57) ABSTRACT

The invention relates to an electric contact device that is part of an electric switching device able to allow or interrupt the passage of the electric current, comprising at least one moving support (33, 35) and a contact pad (60, 62) mounted on the moving support (33, 35), the moving support (33, 35) being able to move to position the contact pad (60, 62) in contact with a fixed contact surface (38, 40) connected to an electrical conductor, the contact pad (60, 62) comprising a contact surface (34, 36) designed to cooperate with said fixed contact surface (38, 40). The contact surface (34, 36) of the contact pad (60, 62) comprises a first spherical portion, comprising an actual zone of contact with said fixed contact surface (38, 40) in the position allowing the passage of current, and, in the continuation of the first spherical portion, a second convex portion with a variable shape going from spherical to cylindrical.
(Continued)

The invention also relates to a low-voltage single-pole phase unit comprising such an electrical contact device.

5 Claims, 6 Drawing Sheets

(51) Int. Cl.
*H01H 73/04* (2006.01)
*H01H 1/66* (2006.01)
*H01H 33/56* (2006.01)
*H01H 1/10* (2006.01)

(52) U.S. Cl.
CPC ..... *H01H 73/045* (2013.01); *H01H 1/10* (2013.01); *H01H 2205/016* (2013.01)

(58) Field of Classification Search
USPC ..... 200/400, 401, 279, 238, 502, 571
See application file for complete search history.

ELECTRICAL CONTACT DEVICE AND LOW-VOLTAGE SINGLE-POLE PHASE UNIT INCORPORATING SUCH AN ELECTRICAL CONTACT DEVICE

BACKGROUND ON THE INVENTION

The present invention relates to an electrical contact device that is part of an electric switching device able to allow or interrupt the passage of an electrical current and a low-voltage single-pole phase unit incorporating such an electrical contact device.

It belongs to the field of low-voltage cutoff devices, and in particular the field of improving the interruption of electrical current, in particular when electric arcs occur.

The invention is particularly applicable in the field of low-voltage multi-pole electrical cutoff apparatuses formed by assembling single-pole phase units, electrically connected to a triggering unit that may comprise magnetothermal or electronic means.

Various models of such modular electrical cutoff apparatuses exist.

One such electrical cutoff apparatus is for example described in patent application FR2986659. This electrical cutoff apparatus comprises at least one single-pole phase unit, and preferably three single-pole phase units, each single-pole phase unit being connected to a triggering unit at a downstream connecting area. Each single-pole cutoff unit also comprises an upstream connecting area, making it possible to connect it to a current line.

Such a single-pole phase unit comprises a housing containing a moving contact bridge comprising a contact surface at each end, a pair of fixed contacts, each fixed contact cooperating with the moving contact bridge, and being connected to an electric current intake conductor. The contact surfaces of the moving contact bridge are respectively arranged on contact pads.

The contact pads play an important role, because they must provide good electrical contact in normal operation under rated current, while being robust with respect to wear.

Document DE4204641 describes a contact having a spherical-type contact surface, so as to monitor the position of the point of contact with an electrical contact, which makes it possible to achieve contact with good mechanical and electrical performance.

However, such a contact pad does not have sufficient performance regarding the elimination of any electric arc that may occur during opening of the contact.

SUMMARY OF THE INVENTION

The invention aims to propose an improved contact device in the event an electric arc occurs, while maintaining very good mechanical and electrical contact performance during normal use.

To that end, according to a first aspect, the invention proposes an electric contact device that is part of an electric switching device able to allow or interrupt the passage of the electric current, comprising at least one moving support and a contact pad mounted on the moving support, the moving support being able to move to position the contact pad in contact with a fixed contact surface connected to an electrical conductor, the contact pad comprising a contact surface designed to cooperate with said fixed contact surface. This electrical contact device is remarkable in that said contact surface of the contact pad comprises a first spherical portion, comprising an actual zone of contact with said fixed contact surface in the position allowing the passage of current, and, in the continuation of the first spherical portion, a second convex portion with a variable shape going from spherical to cylindrical.

Advantageously, the first spherical portion of the contact pad makes it possible to center the actual point of contact, and to guarantee good mechanical and electrical endurance performance. Furthermore, the contact pad comprises, in the continuation of the first spherical portion, a second variable surface portion going from spherical to cylindrical, which allows a faster circulation of an electric arc formed toward the outside of the contact.

The electric contact pad according to the invention may also have one or more of the features below:

- the moving support comprises a rounded end and the second convex portion is formed in the continuation of said rounded end;
- the first spherical portion extends over half of the contact surface, between a first inner edge of the moving support and a central line substantially parallel to said first edge, and the second portion extends over the other half of the contact surface, the surface of said second portion being variable from spherical to cylindrical between said central line and a second outer edge of the moving support.

According to a second aspect, the invention relates to a low-voltage single-pole phase unit comprising a housing, in said housing:

- a moving contact bridge comprising at least one contact surface,
- at least one fixed contact cooperating with the moving contact bridge being connected to an electric current intake conductor.

The moving contact bridge of said single-pole phase unit comprises a contact device as briefly described above.

According to one feature, the single-pole phase unit comprises a pair of fixed contacts, each fixed contact cooperating with the moving contact bridge.

According to one feature, the moving contact bridge comprises two support arms, each support arm comprising a rounded edge able to move in a switching gas discharge chamber.

BRIEF DESCRIPTION OF THE DRAWINGS

Other features and advantages of the invention will emerge from the description thereof provided below, for information and non-limitingly, in reference to the appended figures, in which.

DETAILED DESCRIPTION OF THE PREFERRED EMBODIMENTS

Figure 1:
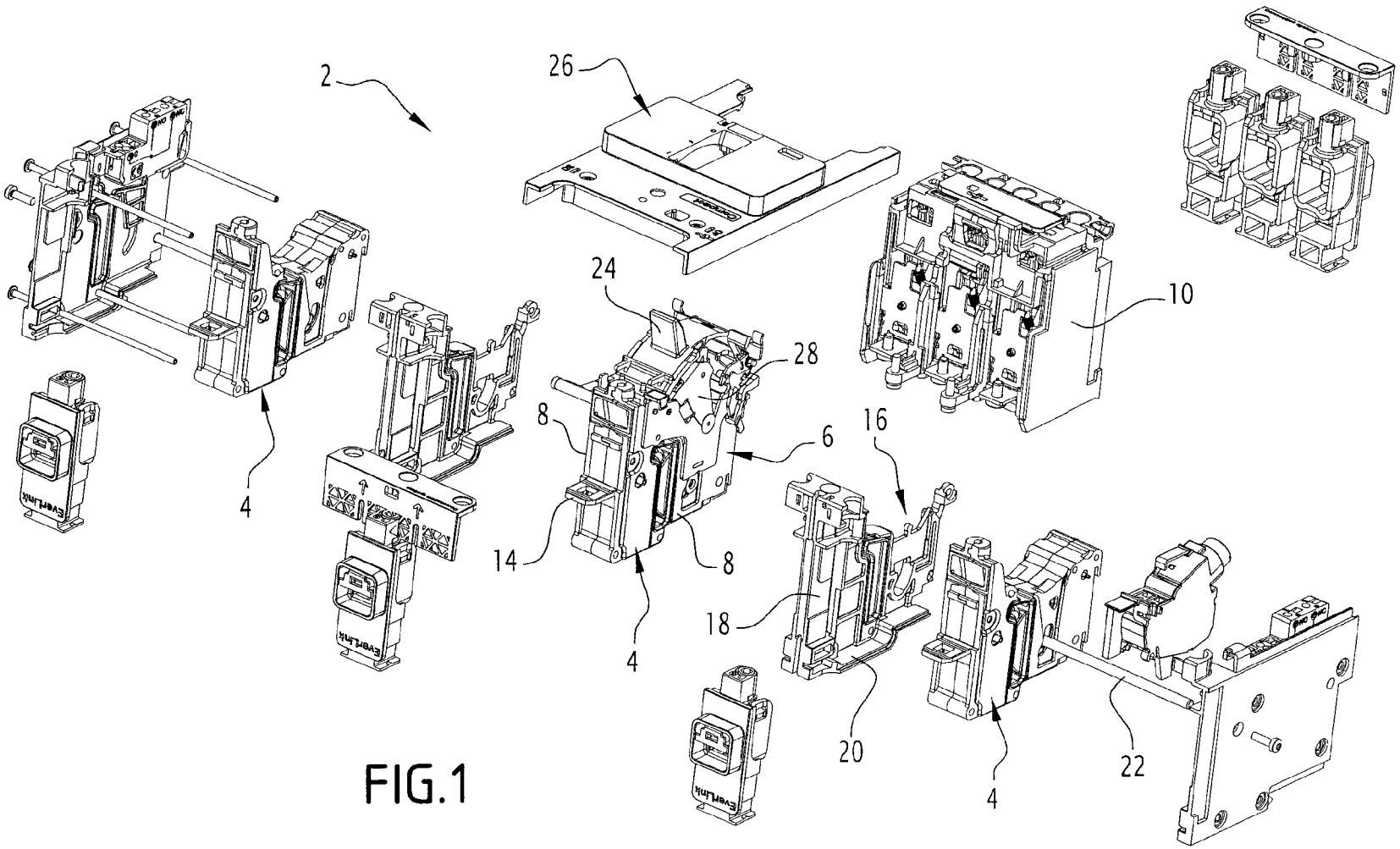
FIG. 1 shows an exploded perspective view of a cutoff apparatus comprising single-pole phase units and a triggering unit according to the invention.

FIG. 1 shows an example of an electrical cutoff apparatus 2 according to one embodiment in an exploded perspective view, comprising three single-pole phase units 4.

According to other embodiments that are not shown, the cutoff apparatus may comprise one, two, three or four single-pole phase units.

Each single-pole phase unit 4 makes it possible to cut off a single pole. Each phase unit assumes the form of a flat housing 6, for example made from molded plastic, formed from two large parallel faces 8, separated by a thickness of approximately 23 millimeters (mm) for a caliber of 160 Amperes (A). The housing is preferably formed by two mirror-image symmetrical parts, secured by any suitable means.

Each single-pole phase unit 4 is connected to a triggering unit 10, which comprises magnetothermal or electronic means, at a downstream connecting area 12 (see FIG. 2) as well as to a current line to be protected at an upstream contact area 14.

In the embodiment illustrated in FIG. 1, the single-pole phase units are assembled using spacers 16, which are for example made from molded plastic, and comprises a central partition 18 designed to be parallel to the large faces 8 of the single-pole phase units 4. The gripping of the spacers 16 on each other is improved by bottom rims 20.

The single-pole phase units are designed to be driven simultaneously and coupled to that end by at least one rod 22.

One of the single-pole phase units comprises a handle 24, able to be housed in the nose 26 of the apparatus, and to control a mechanism 28 for actuating the electric contacts.

Figures 2, 3:
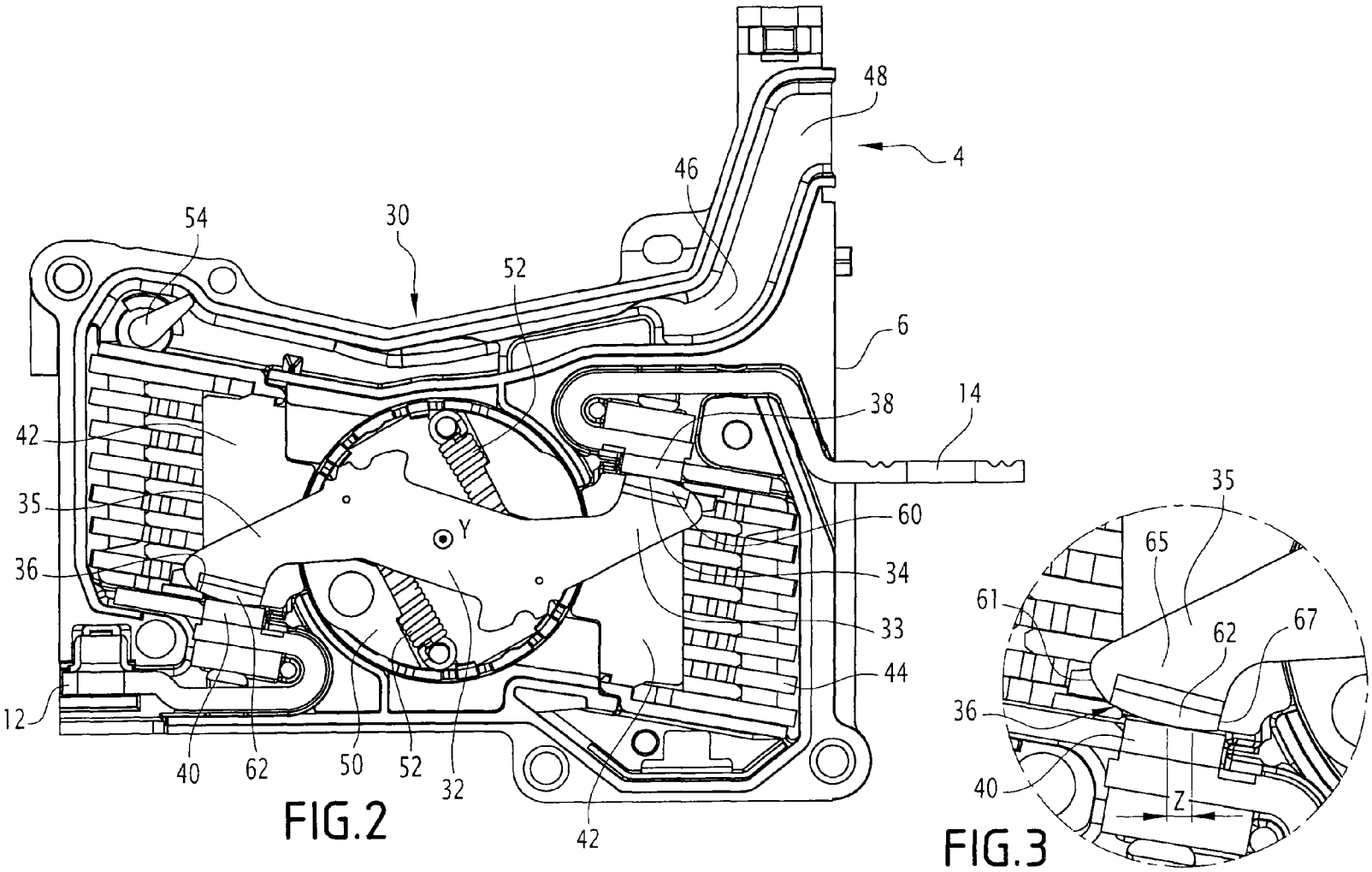
FIG. 2 shows a cross-sectional view of the inside of a single-pole phase unit of the invention.
FIGS. 3 and 4 show details of the contact device according to one embodiment of the invention.

FIG. 2 shows a more detailed view of the contact and cutoff device 30 housed in the housing 6, according to an embodiment in which it involves a double rotating cutoff mechanism, suitable for applications up to 800 A.

The cutoff device 30 comprises a moving contact bridge 32 comprising, in the embodiment of FIG. 2, two symmetrical rotating arms 33, 35, and a moving contact surface 34, 36 at each end of the support formed by a rotating arm 33, 35. It comprises a pair of fixed contacts 38, 40, each fixed contact 38, 40 comprising a fixed contact surface designed to cooperate with a moving contact surface 34, 36 of the moving contact bridge 32.

According to the embodiment shown in FIG. 2, the contact surfaces 34, 36 of the moving contact bridge 32 are respectively positioned on contact pads 60 and 62. As an example embodiment, the contact pads 60 and 62 are fastened to the ends of each rotating arm 33, 35 of the moving contact bridge 32 by a sintering method. The moving contact surfaces 34, 36 then develop on one of the faces of the contact pads 60, 62.

A first fixed contact 38 is designed to be connected to the current line by the upstream connecting area 14. A second fixed contact 40 is designed to be connected to the triggering unit 10 by the downstream connecting area 12.

The contact surfaces of the fixed contacts 38, 40 are planar in this embodiment.

The moving contact bridge 32 is mounted between an open position, in which the moving contact surfaces 34, 36 are separated from the fixed contacts 38, 40, and a closed position, which is an on position for the electrical current, shown in FIG. 2, in which the moving contact surfaces 34, 36 are in contact with each of the contact surfaces of the fixed contacts 38, 40.

The single-pole phase unit 4 comprises two arc cutoff chambers 42 for extinguishing electric arcs. Each arc cutoff chamber 42 comprises at least one stack of at least two de-ionizing fins 44 separated from each other by a switching gas exchange space.

Each arc cutoff chamber 42 comprises at least one outlet connected to at least one exhaust channel 46 for the switching gases, designed to discharge the gases through at least one emerging orifice 48.

According to one particular embodiment, the moving contact bridge 32 is rotatable around an axis of rotation Y. The moving contact bridge 32 is mounted floating in a rotating bar 50 interpolated between the two side faces 8 of the housing 6, by means of connecting elements 52.

At least one exhaust channel 46 comprises a rotating gate 54 designed to be rotated by the passage of the switching gases. The rotating gate 54 is rotated around an axis substantially perpendicular to the exhaust channel 46. The rotation from a first obstruction position to a second triggering position is designed to free the actuating mechanism 28 to cause the moving contact surfaces 34, 36 to open.

Each contact pad 60, 62 is preferably made from silver so as to produce an electrical contact between a moving contact surface 34, 36 of the moving contact bridge 32 and a contact surface of a fixed contact 38, 40.

It should be noted that in the embodiment of FIG. 2, the rotating arms 33, 35, the contact surfaces 34, 36 and the contact pads 60, 62 are symmetrical.

Figure 4:
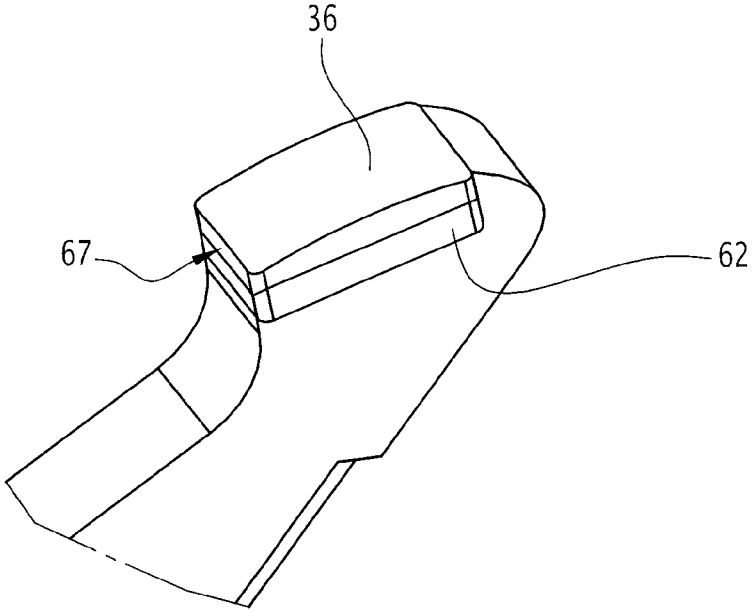
Figure 5:
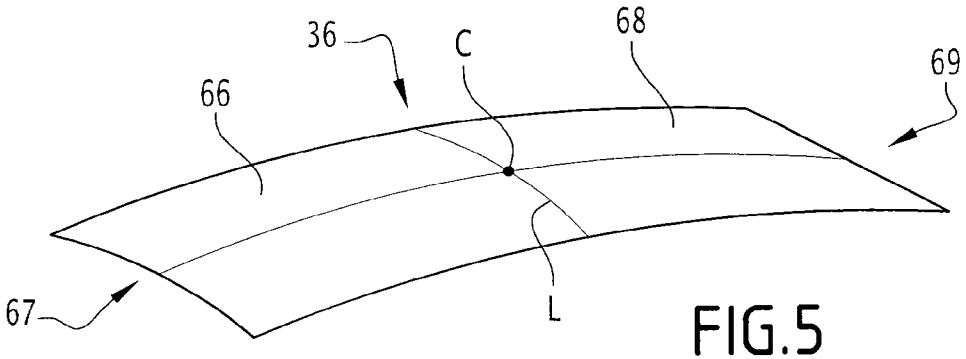
FIG. 5 illustrates an embodiment of the contact surface of a contact pad.

Only one contact pad 62 will be described below in reference to FIGS. 3 to 5, with the understanding that the contact pad 60 has similar characteristics.

According to the preferred embodiment of the invention, the contact pad 62 is incorporated into the free end of the rotating arm 35 so as to provide continuity between the contact surface 36 of the contact pad 62 and the rounded end 65 of the rotating arm 35.

Advantageously, the contact surface 36 of the contact pads 62 according to the invention is formed with a particular geometry combining a first spherical portion 66 at the zone of contact and a second convex portion 68, evolving toward the outside of the contact surface, therefore moving away from the axis of rotation Y of the moving contact bridge 32, toward a cylindrical shape. "The zone of contact Z" refers to the zone of the moving contact surface 36 that is actually in contact with the contact surface of the fixed contact 40.

The contact surface 36 is surrounded by substantially parallel edges, a first inner edge 67 and a second outer edge 69.

In the illustrated embodiment, the first portion 66 extends over half of the contact surface 36, between the first inner edge 67 of the support and a central line L parallel to the first edge 67 and passing through the center C of the contact surface 36.

The second portion 68 extends over the other half of the contact surface 36, between the central line L and the second outer edge 69.

The characteristics of the portions 66 and 68 are determined such that each one occupies approximately 50% of the contact surface.

The contact surface 36 is made during welding of the contact pad 62 to the support of the rotatable arm 35.

Alternatively, the contact surface 36 is made by a combination of sintering and welding by passing current.

Advantageously, the zone of contact Z is positioned such that the repeated contacts cause regular wear of the parts 62, 40 and guarantee good mechanical and electrical endurance of the contact.

Figure 6:
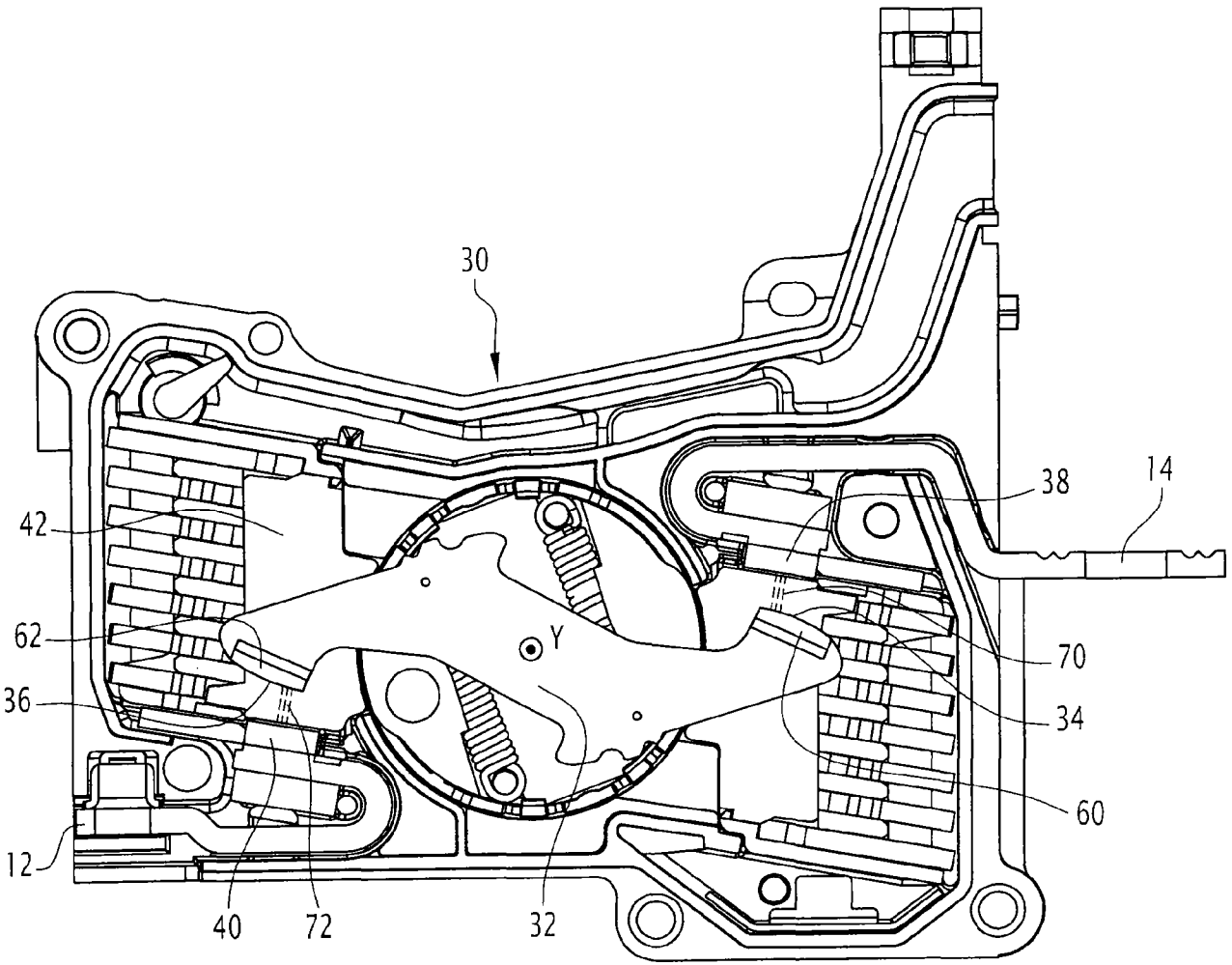
FIGS. 6 to 8 illustrate the operation of a single-pole phase unit according to one embodiment of the invention.
Figure 7:
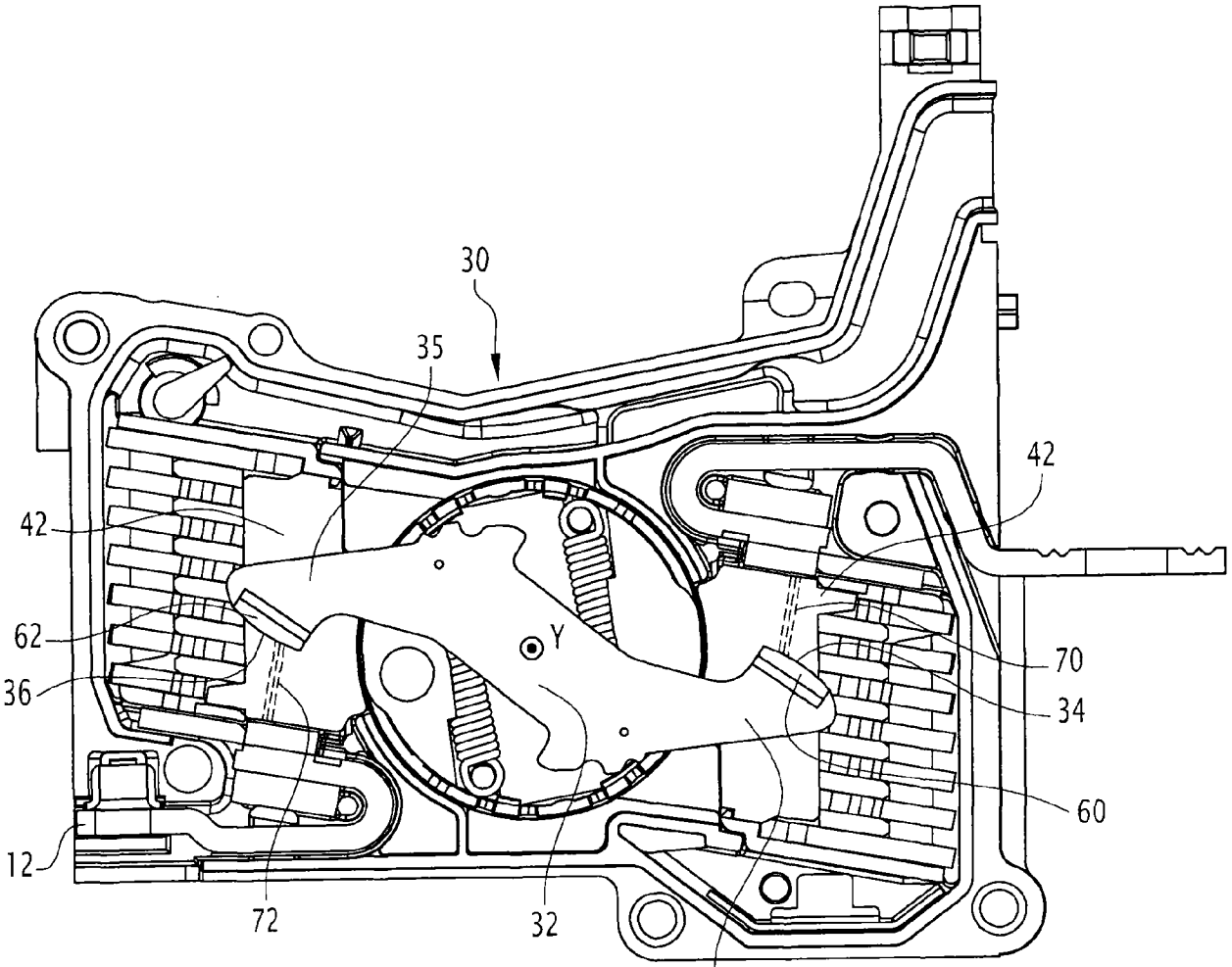
Figure 8:
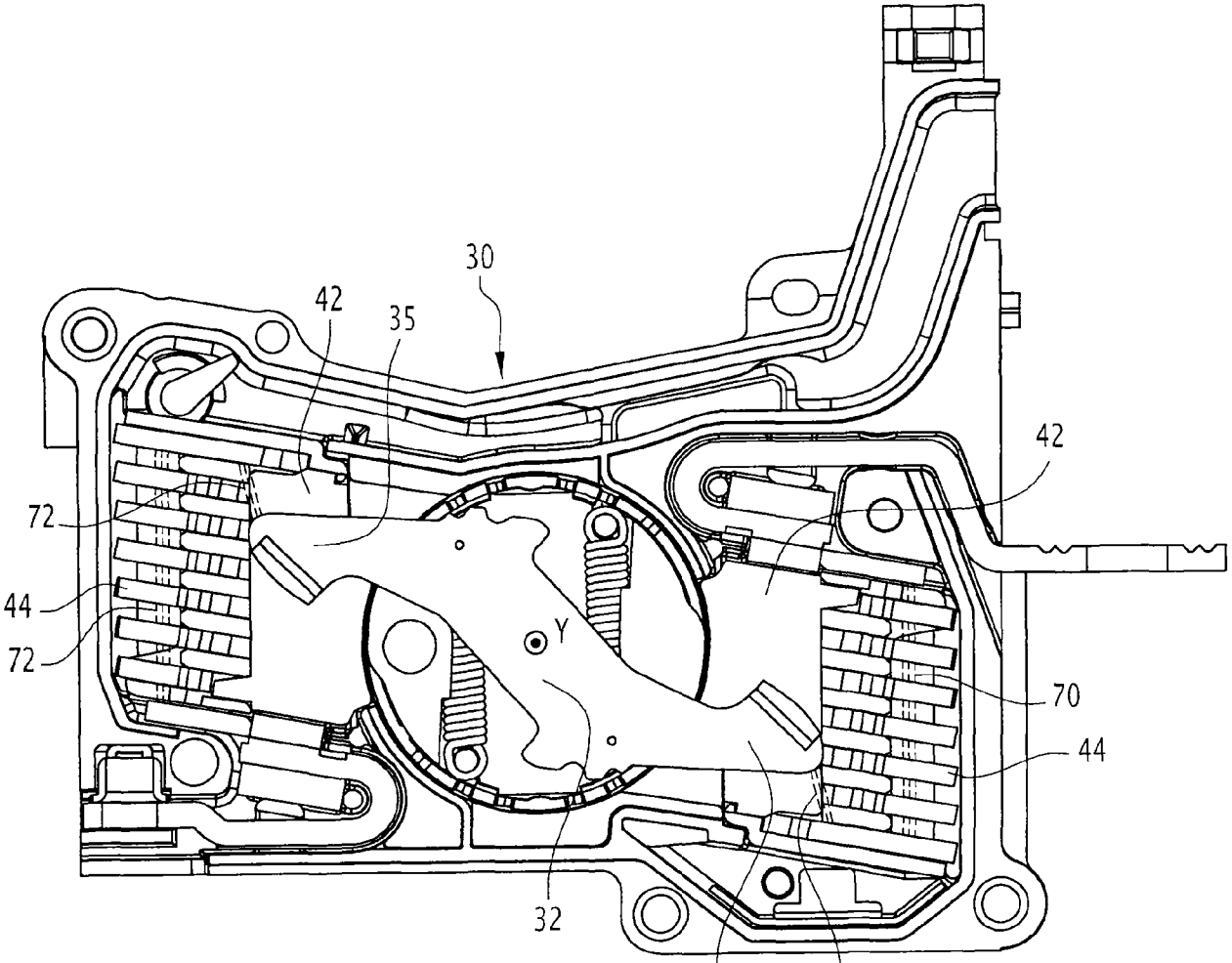

Furthermore, advantageously, the production of the second portion 68 makes it possible to obtain substantially perfect continuity between the contact pads 62 and the support of the rotatable arm supporting the contact pad, which allows an optimized circulation of an electric arc toward the discharge chamber 42, and more generally toward the outside of the moving contact bridge 32 during opening of the contacts, as illustrated in more detail in FIGS. 6 to 8. "Outside of the moving contact bridge 32" here refers to the zones situated outside the ends of the rotating arms 33, 35 opposite the axis of rotation Y.

FIGS. 6 to 8 illustrates several steps of the opening of the moving contact bridge 32 illustrated in FIG. 3.

As illustrated in FIG. 6, during opening of the contacts of the single-pole phase unit 4, in a first phase, an electric arc 70, 72 forms between the moving contact pad 60, 62 and the fixed contact 38, 40.

In particular, owing to the shape of each contact surface 34, 36 and in particular its second convex portion 68 in the continuation with a cylindrical shape, the electric arc 70, 72 moves toward the outside of the moving contact bridge 32 at each rotating arm (FIG. 7), until complete discharge toward the cutoff chambers 42 at the deionizing fins 44, by the outer edges of the rotating arms 33, 35 (FIG. 8).

The invention has been described above in one particular embodiment, the contact device being implemented in a single-pole phase unit having a particular structure.

However, the invention is applicable in any electric switching apparatus, inasmuch as there is a need to maintain good mechanical and electrical contact performance during normal use, while facilitating the elimination of electric arcs toward a given outer zone of the support of the contact pad.

The invention claimed is:

1. An electric contact device that is part of an electric switching device able to allow or interrupt the passage of the electric current, comprising at least one moving support and a contact pad mounted on the moving support, the moving support being able to move to position the contact pad in contact with a fixed contact surface connected to an electrical conductor, the contact pad comprising a contact surface designed to cooperate with said fixed contact surface, wherein said contact surface of the contact pad comprises a first spherical portion, comprising an actual zone of contact with said fixed contact surface in a position allowing the passage of current, and, in continuation of the first spherical portion, a second convex portion with a variable shape going from spherical to cylindrical, wherein the first spherical portion extends over half of the contact surface, between a first inner edge of the moving support and a central line substantially parallel to said first edge, and the second portion extends over another half of the contact surface, a surface of said second portion being variable from spherical to cylindrical between said central line and a second outer edge of the moving support.

2. The electric contact device according to claim 1, wherein the moving support comprises a rounded end and the second convex portion is formed in the continuation of said rounded end.

3. A low-voltage single-pole phase unit comprising a housing, and, in said housing:

a moving contact bridge comprising at least one contact surface, at least one fixed contact cooperating with the moving contact bridge and connected to an electric current intake conductor, characterized in that the moving contact bridge comprises a contact device according to claim 1.

4. The single-pole phase unit according to claim 3, comprising a pair of fixed contacts, each fixed contact cooperating with the moving contact bridge.

5. The single-pole phase unit according to claim 4, wherein the moving contact bridge comprises two support arms, each support arm comprising a rounded edge able to move in a switching gas discharge chamber.

* * * * *